US006918581B2

(12) United States Patent
Horiuchi

(10) Patent No.: US 6,918,581 B2
(45) Date of Patent: Jul. 19, 2005

(54) PAPER SHEET TAKE-OUT APPARATUS

(75) Inventor: Haruhiko Horiuchi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/662,331

(22) Filed: Sep. 16, 2003

(65) Prior Publication Data

US 2004/0075209 A1 Apr. 22, 2004

(30) Foreign Application Priority Data

Oct. 18, 2002 (JP) ..... 2002-304615

(51) Int. Cl.[7] ..... B65H 3/12

(52) U.S. Cl. ..... 271/96; 271/104; 271/105; 271/108

(58) Field of Search ..... 271/94, 96, 98, 271/104, 105, 108, 112

(56) References Cited

U.S. PATENT DOCUMENTS

| | | | | |
|---|---|---|---|---|
| 1,696,705 A | | 12/1928 | Aldrich | |
| 1,697,752 A | | 1/1929 | Broadmeyer | |
| 3,403,904 A | | 10/1968 | Kim | |
| 3,572,686 A | | 3/1971 | Day | |
| 3,669,446 A | * | 6/1972 | Derc et al. | 271/94 |
| 3,961,784 A | * | 6/1976 | Sevak et al. | 271/94 |
| 4,662,622 A | * | 5/1987 | Wimmer et al. | 271/96 |
| 5,354,045 A | * | 10/1994 | Boldrini et al. | 271/11 |

FOREIGN PATENT DOCUMENTS

| | | |
|---|---|---|
| FR | 2 461 668 | 2/1981 |
| GB | 288616 | 9/1928 |
| JP | 5-87204 | 4/1993 |
| JP | 5-286597 | 11/1993 |
| JP | 8-151135 | 6/1996 |
| JP | 9-202467 | 8/1997 |
| JP | 9-301547 | 11/1997 |
| JP | 11-222327 | 8/1999 |

OTHER PUBLICATIONS

European Search Report for EP 03 02 0889, dated Oct. 27, 2004.

* cited by examiner

*Primary Examiner*—David H. Bollinger
(74) *Attorney, Agent, or Firm*—Pillsbury Winthrop Shaw Pittman LLP

(57) ABSTRACT

A paper sheet take-out apparatus comprises a paper feed table on which paper sheets are placed as a stack, a take-out rotor which absorbs and takes out the uppermost paper sheet placed on the paper feed table, and a positioning mechanism which positions the uppermost paper sheet with respect to the take-out rotor by causing an absorption block to absorb the paper sheet before taking out the uppermost paper sheet.

18 Claims, 7 Drawing Sheets

PAPER SHEET TAKE-OUT APPARATUS

CROSS-REFERENCE TO RELATED APPLICATIONS

This application is based upon and claims the benefit of priority from the prior Japanese Patent Application No. 2002-304615, filed Oct. 18, 2002, the entire contents of which are incorporated herein by reference.

BACKGROUND OF THE INVENTION

1. Field of the Invention

The present invention relates to a vacuum absorption type paper sheet take-out apparatus applied to a separator/processor which separates and stacks paper sheets, for example.

2. Description of the Related Art

There is a type of paper sheet take-out apparatus, which absorbs and takes out a paper sheet by the rotation of a take-out rotor. The rotation system of the take-out rotor is largely divided into two types, an intermittent rotation system and a continuous rotation system.

(1) The intermittent rotation system stops the rotation of a take-out rotor when the take-out rotor absorbs a paper sheet, as disclosed in the Jpn. Pat. Appln. KOKAI Publication No. 5-87204. In this system, a detection lever contacts the upper surface of a paper sheet, and a paper feed table moves up and down to keep the contacting position constant with reference to the take-out rotor, to control the positional relationship between the take-out rotor and the paper sheet.

(2) The continuous rotation system has a speed difference between a paper sheet and the take-out rotor, when the take-out rotor rotates at a predetermined speed and absorbs a paper sheet, as disclosed in the Jpn. Pat. Appln. KOKAI Publication No. 9-301547. In this system, a press sensor is provided on a paper feed table, and the paper feed table moves up and down to keep the pressure constant when a paper sheet is pressed to the take-out rotor, to control the positional relationship between the take-out rotor and the paper sheet.

However, in the intermittent rotation system, as the take-out rotor must be intermittently rotated, there is a problem that the mechanism is complicated and the operation is noisy.

Moreover, the detection lever, which detects the positional relationship between the paper sheet and the take-out rotor, is unstable under the influence of the picked-up paper sheet, and the positional relationship between the take-out rotor and paper sheet becomes also unstable, causing unstable take-out of the paper sheet. That is, a paper sheet cannot be taken out when it is separated too far from the take-out rotor, and paper sheets are doubly fed when too close to the take-out rotor.

On the other hand, in the continuous rotation system, a paper sheet is dynamically absorbed by the take-out rotor, not statically, and it is necessary for stable take-out of paper sheets to accurately control the positional relationship between the take-out rotor and paper sheet.

However, in this system, as the position of a paper sheet is controlled by pressing the paper sheet to the take-out rotor, there is a problem that double paper feeding is likely to occur.

The present invention has been made to solve the above problems. Accordingly, it is an object of the present invention to provide a paper sheet take-out apparatus which is simple in structure and quiet in operation, and which can prevent double paper feeding.

BRIEF SUMMARY OF THE INVENTION

According to an aspect of the present invention, there is provided a paper sheet take-out apparatus comprising a means for placing paper sheets as a stack, a take-out rotor which absorbs and takes out the uppermost paper sheet placed on the means for placing paper sheets, and a device for absorbing and positioning the uppermost paper sheet with respect to the take-out rotor before the take-out rotor takes out the uppermost paper sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

The present invention will be explained in detail hereinafter with reference to the embodiments shown in the attached drawings.

Figure 1:
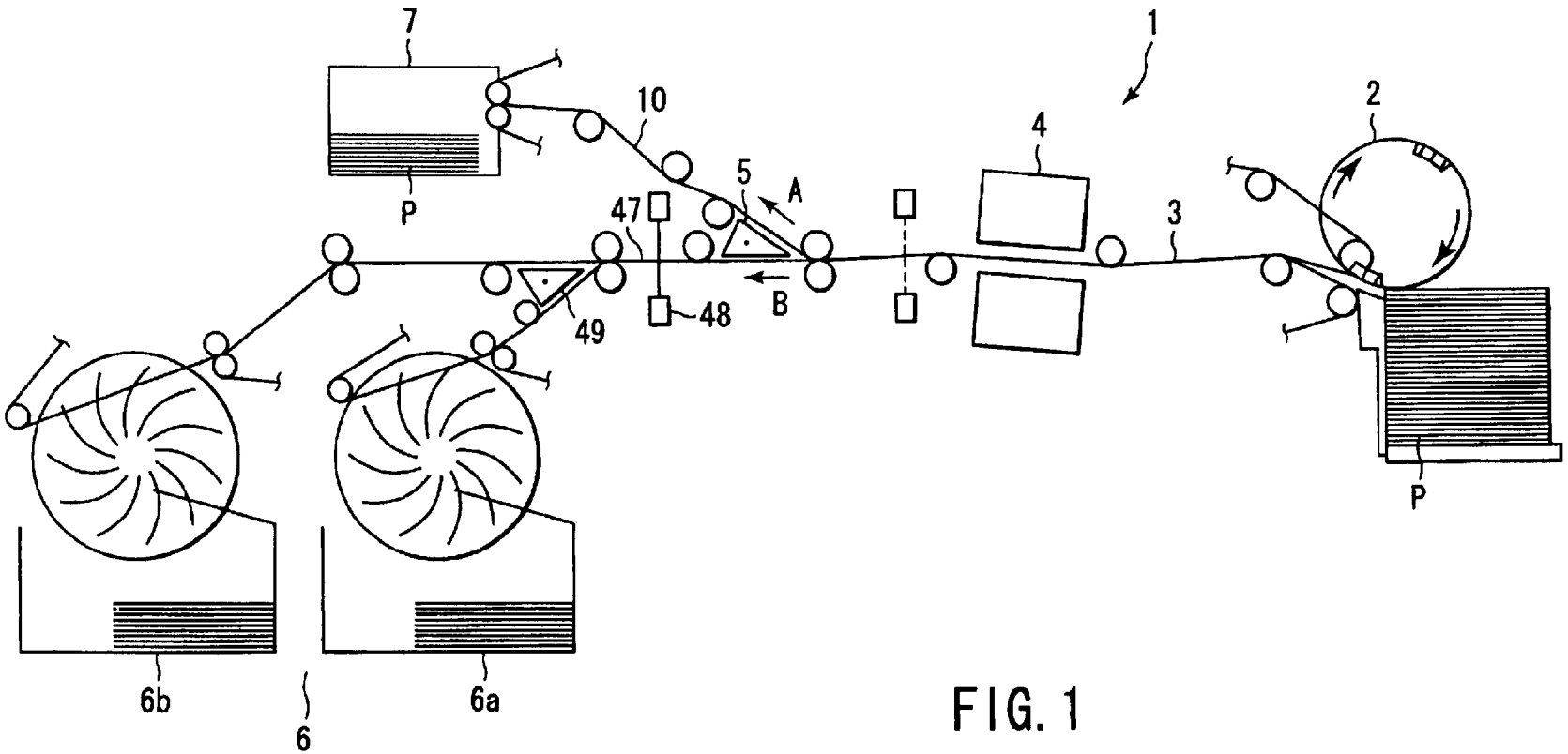
FIG. 1 is a schematic block diagram showing a paper sheet processor according to an embodiment of the present invention.

FIG. 1 is a schematic block diagram showing a processor 1 which separates and stacks paper sheets such as securities.

The paper sheet processor 1 comprises a take-out apparatus 2 which takes out paper sheets P one by one, a conveying unit 3 which conveys the paper sheet P taken out by the take-out apparatus 2, and a reading unit 4 which reads the information of the paper sheet P conveyed by the conveying unit 3. The paper sheet processor 1 further comprises a separator 5 which separates the paper sheet P read by the reading unit 4 into two or more directions according to the read information, a stack unit 6 which consists of fist and second stack units 6*a* and 6*b* to stack the paper sheet P separated by the separator 5, and a stack unit 7 which stacks an ejected paper sheet P.

When processing the paper sheets P, the take-out apparatus 2 sequentially separates and takes out the stacked paper sheets P one by one starting from the uppermost one. The taken-out paper sheet P is transferred to the conveying unit 3, and conveyed by the conveying unit 3 at a constant speed. The information on the paper sheet P is read by the reading unit 4, and the paper sheet is separated to a first or second conveying direction A or B based on the read information. The paper sheet P separated to the first conveying direction A is sent to the ejected paper stack unit 7 through a first branch conveying path 10. The paper sheet P separated to the second conveying direction B is sent to the first or second stack unit 6*a* or 6*b* through a second branch conveying path 47 and a separator 49, and stacked again as a bundle.

An optical sensor 48 provided in the conveying path 47 counts the number of the paper sheets P passing through the sensor and conveyed to the stack unit 6, and each time the sensor counts 100 sheets, the separator 49 is rotated and the 100 paper sheets P are stacked alternately in the first stack unit 6*a* or the second stack unit 6*b*. Like the stack unit 6, the ejected paper stack unit 7 receives and stops the conveyed paper sheets P, and stacks them again as a bundle.

Figure 2:
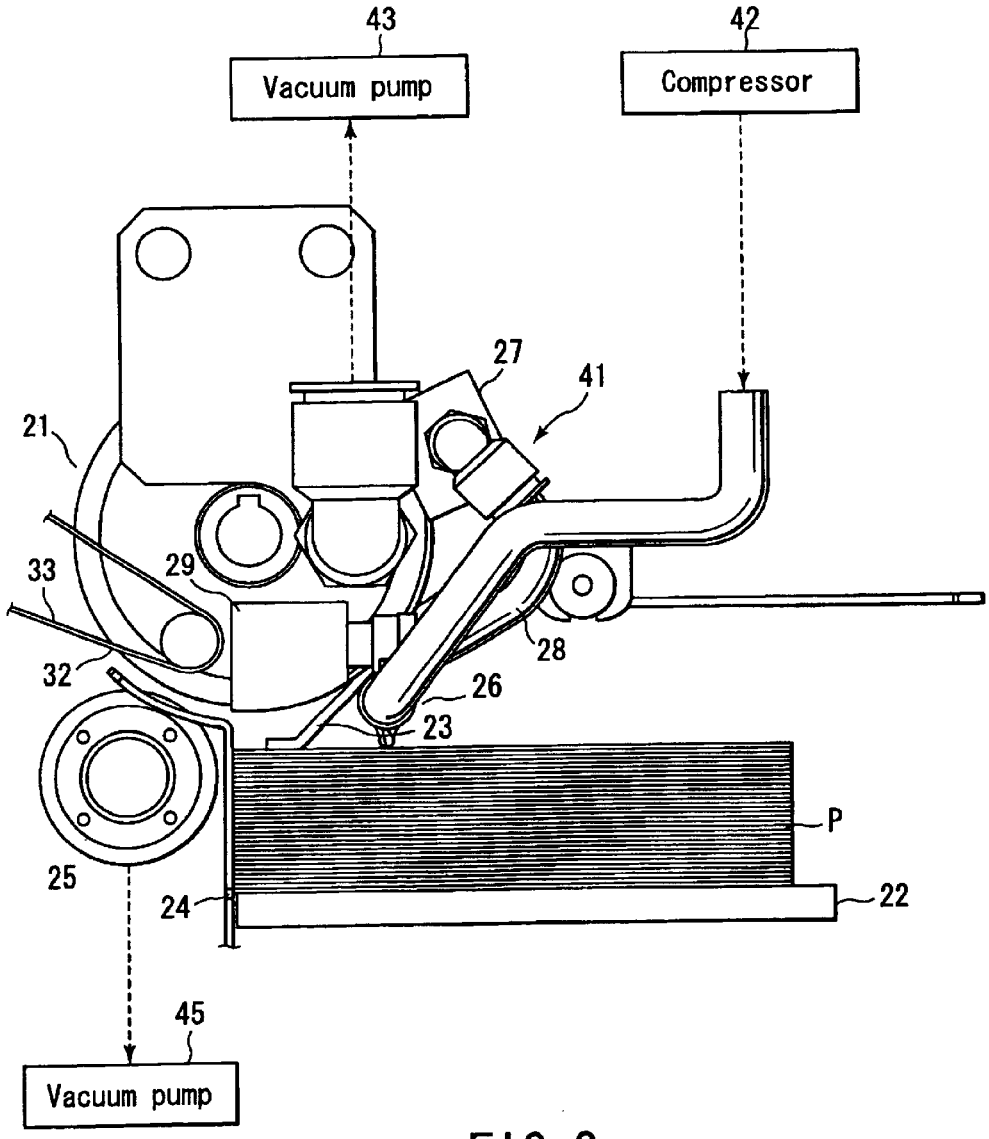
FIG. 2 is a front view showing a paper sheet take-out apparatus provided in the paper sheet processor.
Figure 3:
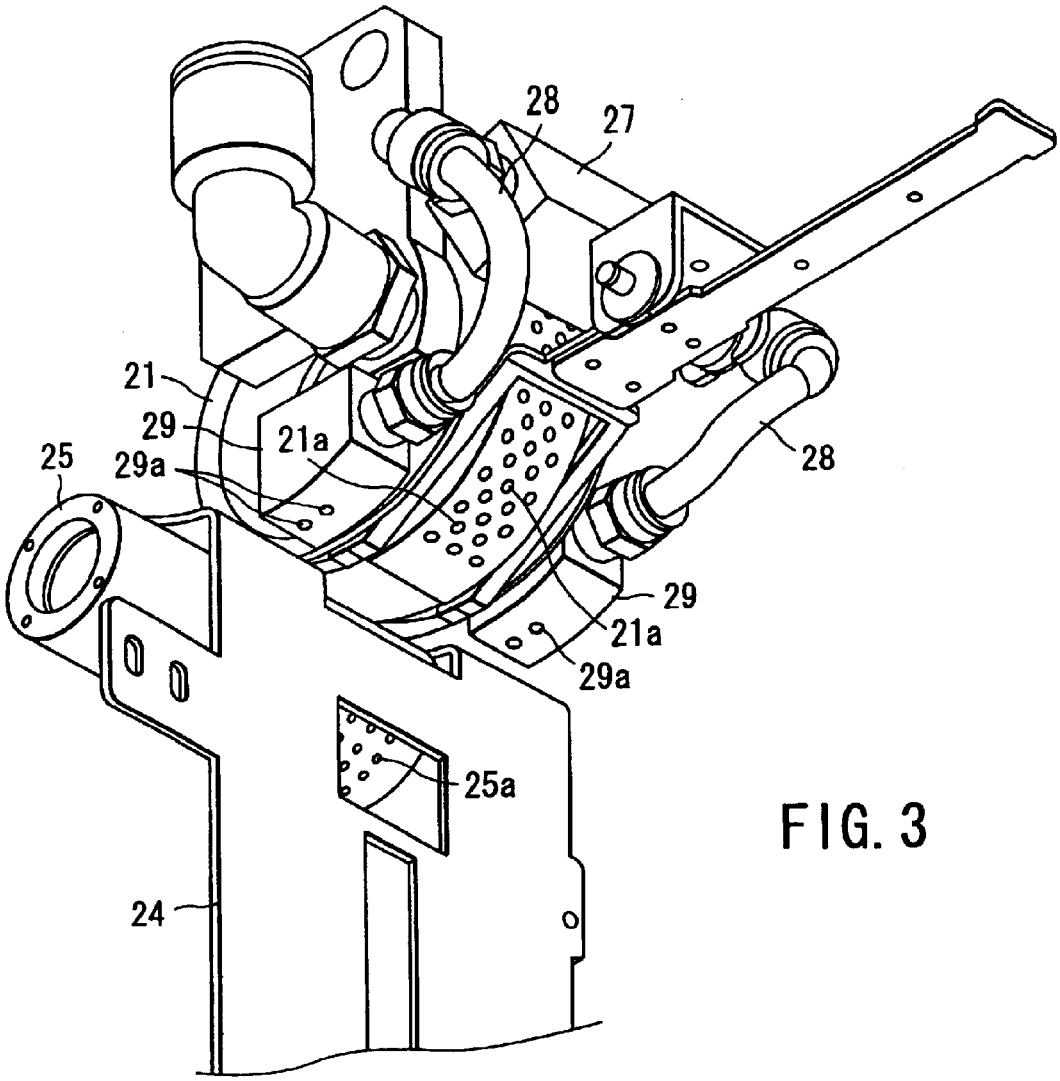
FIG. 3 is a perspective view showing the paper sheet take-out apparatus.

FIG. 2 is a front view showing the configuration of the take-out apparatus 2. FIG. 3 is a perspective view of the take-out apparatus 2.

In FIGS. 2 and 3, a reference numeral 21 denotes a take-out rotor. The take-out rotor 21 is continuously rotated by a driving mechanism (not shown). A plurality of suction ports 21*a* is bored in a part of the circumferential surface of the take-out rotor 21. In the lower part of the take-out rotor 21, a paper feed table 22 is provided movably up and down as a placing device. Paper sheets P are placed like a stack on the paper feed table 22. The paper feed table 22 is moved up and down by a not shown driving mechanism.

In the upper part of the paper feed table 22, a detection lever 23 is provided to detect the upper surface position of the stacked paper sheets. The detection lever 23 converts the upper surface position of the paper sheets P into an electrical signal, and transmits the position information to a controller (not shown). Based on the position information, the controller moves the paper feed table 22, and controls the position so that the upper surface of the paper sheets P is located at a predetermined position near the take-out rotor 21.

At both ends of the paper feed table 22, an air nozzle 26 is fixedly provided. The air nozzle 26 has the function of arranging and floating the paper sheets P by ejecting the air supplied from a compressor 42.

In the vicinity of the take-out rotor 21, a positioning mechanism 41 is provided as a positioning device, which determines the position of a paper sheet P to be taken out by the take-out rotor 21, as described in detail later.

Further, in the front of the paper feed table 22, a guide plate 24 is fixedly provided. The guide plate 24 has the function of neatly aligning the front ends of the paper sheets P and transferring the paper sheet P to the conveying unit 3, after correcting the posture by guiding the lower side of the paper sheet when it is taken out in the rotating direction of the take-out rotor 21.

Further, in the lower part of the take-out rotor 21, a separation roller 25 is provided to prevent double feeding of the paper sheets P.

Figure 4:
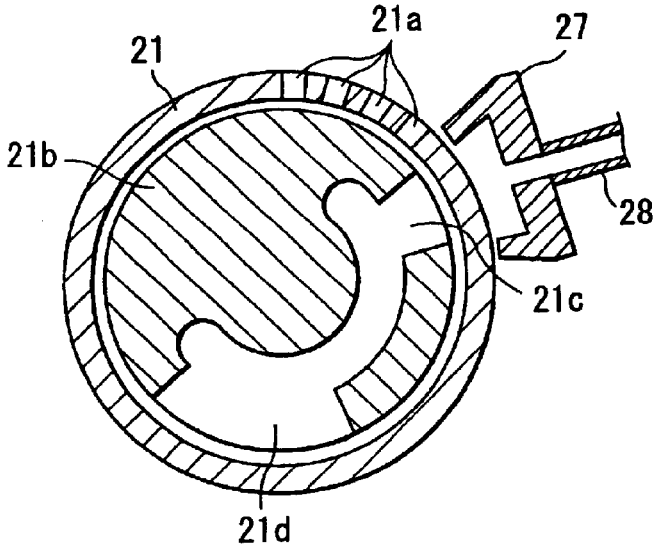
FIG. 4 is a sectional view showing a take-out rotor of the paper sheet take-out apparatus.

FIG. 4 is a sectional view showing the take-out rotor 21.

In the take-out rotor 21, a chamber member 21*b* is fixedly provided. The inside of the chamber member 21*b* is kept at a negative pressure by a vacuum pump 43. In the chamber member 21*b*, first and second notches 21*c* and 21*d* for opening the interior to the outside are formed at a predetermined interval over the rotating direction of the take-out rotor 21.

In a part of the circumferential surface of the take-out rotor 21, a plurality of suction ports 21*a* is bored, and when the take-out rotor 21 rotates and the suction ports 21*a* face and connect with the notches 21*c* and 21*d* of the chamber member 21*b*, air is taken in from the suction ports 21*a*.

Figure 5:
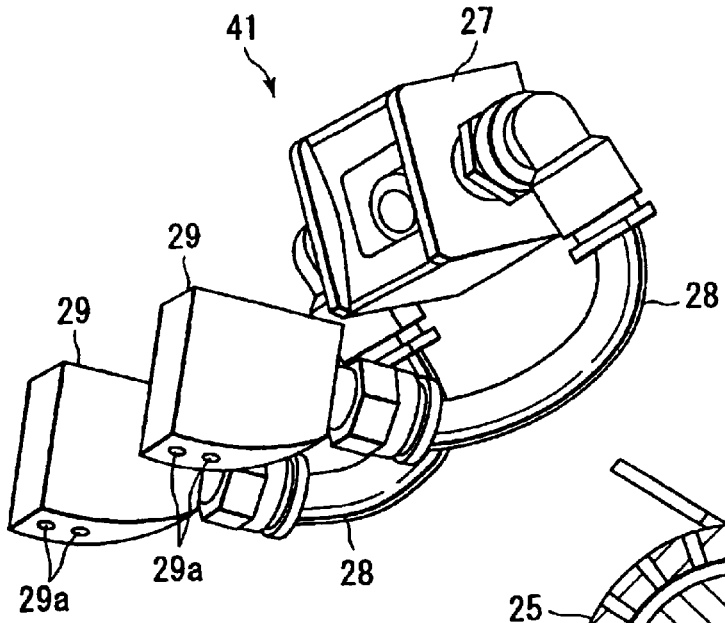
FIG. 5 is a perspective view showing the positioning mechanism of the paper sheet take-out apparatus.

FIG. 5 is a perspective view showing the positioning mechanism 41, which determines the position of a paper sheet P absorbed by the take-out rotor 21.

The positioning mechanism 41 consists of a chamber 27 and a pair of absorption blocks 29, 29, which are connected to the chamber 27 through a pair of connection tubes 28, 28 as a connection pipe.

The chamber 27 is opposite to the circumferential surface of the take-out rotor 21, as shown in FIG. 4. The pair of absorption blocks 29, 29 are arranged on both sides of the take-out rotor 21 with the suction ports 29*a*, 29*a* facing to the upper surface of the stacked paper sheets, as shown in FIG. 3.

When the suction port 21*a* of the take-out rotor 21 faces and connects with the first notch 21*c* of the chamber member 21*b*, air is taken in from the suction ports 29*a*, 29*a* of the absorption blocks 29, 29 through the chamber 27 and the connection tube 28 of the positioning mechanism 41.

Figure 6:
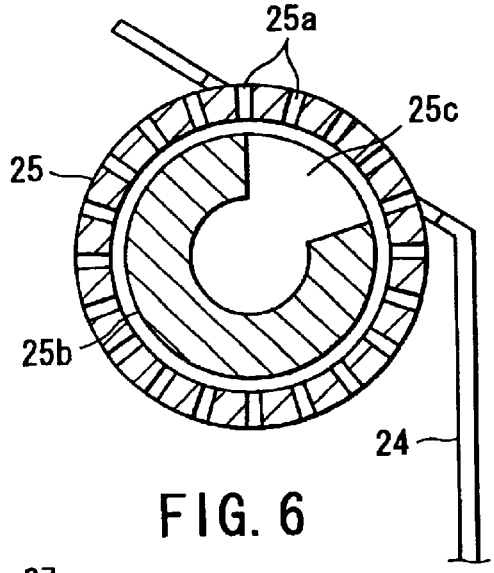
FIG. 6 is a sectional view showing a separating roller of the paper sheet take-out apparatus.
Figure 7:
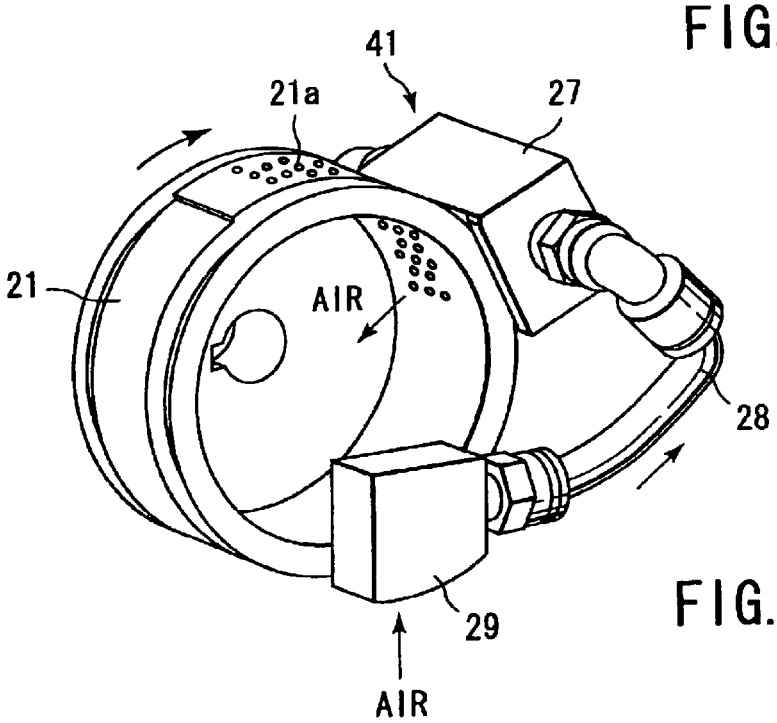
FIG. 7 is a perspective view showing the state that an absorbing force is given to a absorption block by the absorbing force of the take-out rotor.

FIG. 6 is a sectional view showing the above-mentioned separation roller 25.

The separation roller 25 is cylindrical, and has a plurality of suction ports 25*a* on the circumferential surface. In the inside of the separation roller 25, a chamber 25*b* is fixedly provided, and the inside of the chamber 25*b* is kept at a negative pressure by a vacuum pump 45 (shown in FIG. 2). The chamber 25*b* is formed with a notch 25*c*, and when the suction port 25*a* of the separation roller 25 faces and connects with the notch 25*c*, air is taken in through the suction port 25*a*.

The separation roller 25 is rotated by a driving mechanism (not shown) in the direction to prevent the paper sheet P from being taken out. The separation roller 25 has the function of absorbing a paper sheet P not absorbed by the take-out rotor 21, and stopping the take-out operation, to prevent more than one paper sheet P from being fed simultaneously into the conveying path by the take-out rotor 21.

Now, the paper sheet take-out operation will be explained with reference to FIG. 2 and FIG. 7 to FIG. 10.

When a paper sheet P is taken out, the paper feed table 22 rises, as shown in FIG. 2, and stops rising when the upper surface of the paper sheets P stacked on the paper feed table 22 is detected by the detection lever 23. In this state, the vacuum pump 43 is operated, the inside of the chamber member 21*b* of the take-out rotor 21 is kept at a negative pressure, and the take-out rotor 21 is rotated by a driving mechanism (not shown).

When the suction port 21*a* of the take-out rotor 21 faces and connects with the first notch 21*c* of the chamber member 21*b* by the rotation of the take-out rotor, air is talen in from the suction ports 29*a*, 29*a* of the absorption blocks 29, 29 through the chamber 27 and the connection tubes 28, 28 of the positioning mechanism 41 by the negative pressure in the chamber member 21*b*.

Figure 8:
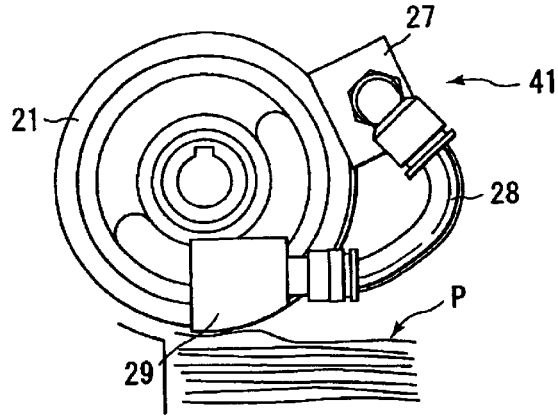
FIG. 8 is a perspective view showing the state that a paper sheet is absorbed and positioned by the absorption block.

Thus, as shown in FIG. 8, the uppermost paper sheet P is absorbed by the absorption blocks 29, 29 and positioned with respect to the take-out rotor 21. When the take-out rotor 21 is rotated furthermore from this state and the suction port 21*a* does not face and does not connect with the first notch 21*c* of the chamber 21*b*, the absorption blocks 29, 29 stop absorbing the paper sheet P.

Figure 9:
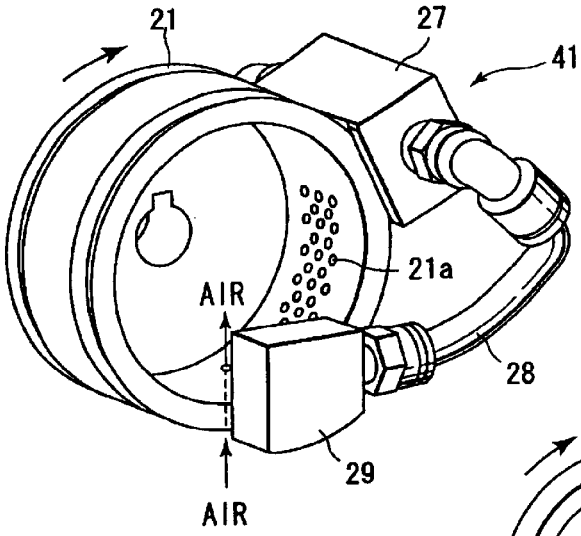
FIG. 9 is a perspective view showing that the absorbing force given to the absorption block is stopped.
Figure 10:
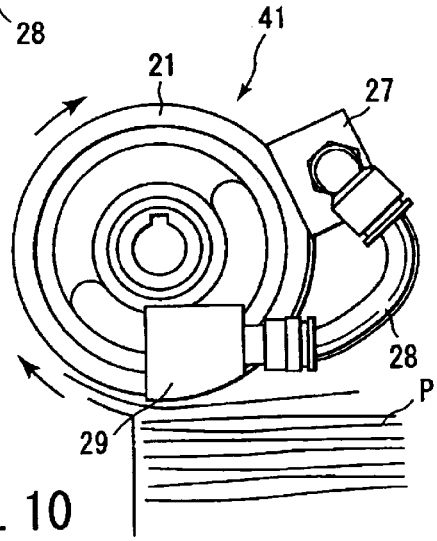
FIG. 10 is a perspective view showing that the absorption of a paper sheet by the absorption block is stopped and the paper sheet is taken out by the take-out rotor.

In this time, the suction port 21*a* of the take-out rotor 21 faces and connects with the second notch 21*d* of the chamber 21*b*, air is taken in as shown in FIG. 9, and the take-out rotor absorbs and takes out the paper sheet P absorbed by the absorption blocks 29, 29.

The taken-out paper sheet P is transferred to a transfer unit 32 of a conveying belt 33, but in this time, the suction port 21 shifts from the second notch 21*d* of the chamber member 21*b*, and the air intake is stopped. Therefore, the paper sheet P is separated from the take-out rotor 21 by the conveying belt 33, transferred to the transfer unit 32, and conveyed.

Conversely, when the paper sheet P is taken out by the take-out rotor 21, the separation roller 25 is rotated in the direction reverse to the take-out direction, a negative pressure is given by the operation of the vacuum pump 45, air is taken in from the suction port 25*a*, and the paper sheet P is absorbed. Thus, when two paper sheets are going to be taken out at a time by the take-out rotor, the lower side paper sheet is reversely fed and separated, and only the uppermost paper sheet P is taken out. Thereafter, the paper sheets will be sequentially separated and taken out one by one in the same way.

As above described, the paper sheet P is absorbed by the absorption blocks 29, 29, and the paper sheet P can be taken out at an equal speed without rotating intermittently the take-out rotor 21. Therefore, the mechanism can be simplified, and the operation noise can be reduced.

The position of a paper sheet P is unstable while being arranged and floated by the air nozzle 26, but the position of the paper sheet P is stabilized when absorbed by the absorption blocks 29, 29, and the disturbance in the pitch of the taken-out paper sheet P can be reduced.

In a take-out rotor with a constant rotation speed, the position of the uppermost surface of the paper sheets is determined by pushing up the whole stack of paper sheets and pressing them against the take-out rotor. In this embodiment, the position of a paper sheet P is determined by absorbing a paper sheet P by the absorption blocks 29, 29, and it is unnecessary to press a paper sheet P against the take-out rotor 21. Therefore, an air layer is formed between the absorbed paper sheet P and the stacked paper sheet P, preventing double feeding of paper sheets P.

Further, the timing of absorbing a paper sheet P by the absorption blocks 20, 29 is shifted from the timing of absorbing and taking out the paper sheet P by the suction port 21*a* of the take-out rotor 21, and the absorption of the paper sheet P by the absorption blocks 29, 29 does not affect the paper sheet take-out operation.

Figure 11:
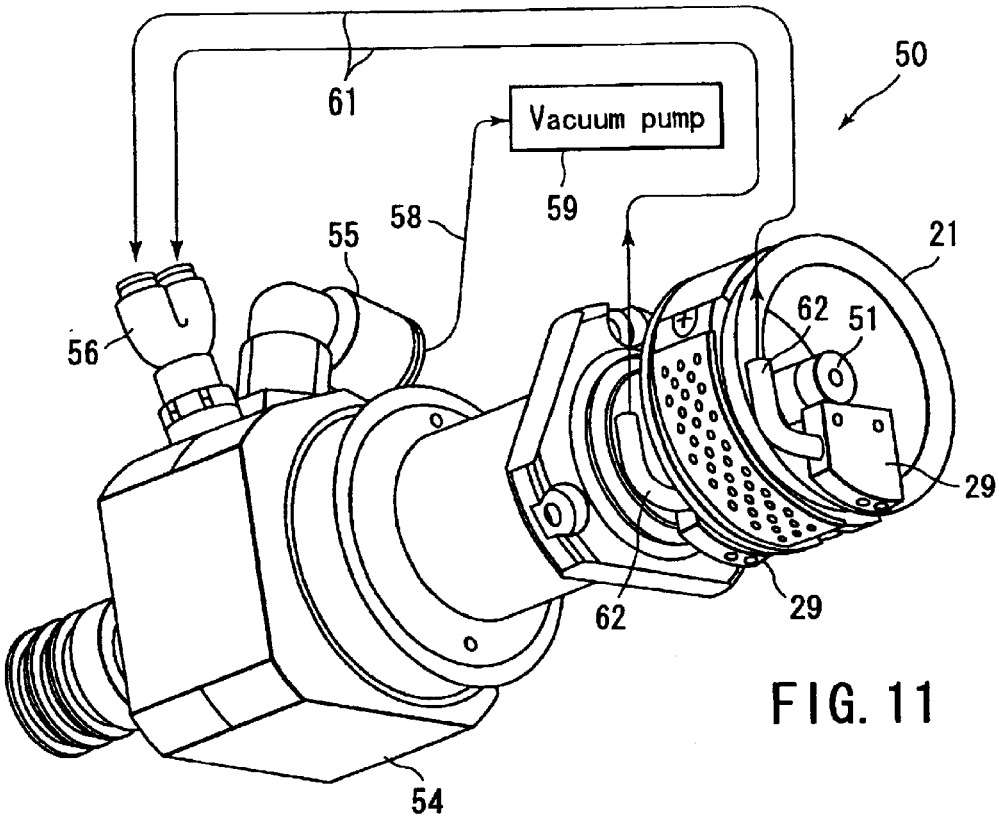
FIG. 11 is a perspective view showing a paper sheet take-out apparatus according to a second embodiment of the present invention.

FIG. 11 is a perspective view showing a positioning mechanism (positioning means) 50 of a paper sheet take-out apparatus according to a second embodiment of the present invention.

The same reference numerals are given to the same parts as those shown in the first embodiment, and detailed explanation will be omitted.

In the second embodiment, the take-out rotor 21 is connected to one end of a driving shaft 51, and a rotary valve 52 is connected to the other end of the driving shaft 51. The take-out rotor 21 and rotary valve 52 are synchronously rotated by the rotation of the driving shaft 51.

The rotary valve 52 is covered by a valve cover 54, and the valve cover 54 is fixedly held. The valve cover 54 is connected with first and second piping members 55, 56, which form an air absorption mechanism. The first piping member 55 is connected to a vacuum pump 59 through a tube 58. The second piping member 56 is connected to air absorption pipes 62, 62 of the absorption block 29, 29 through tubes 61, 61.

Figure 12:
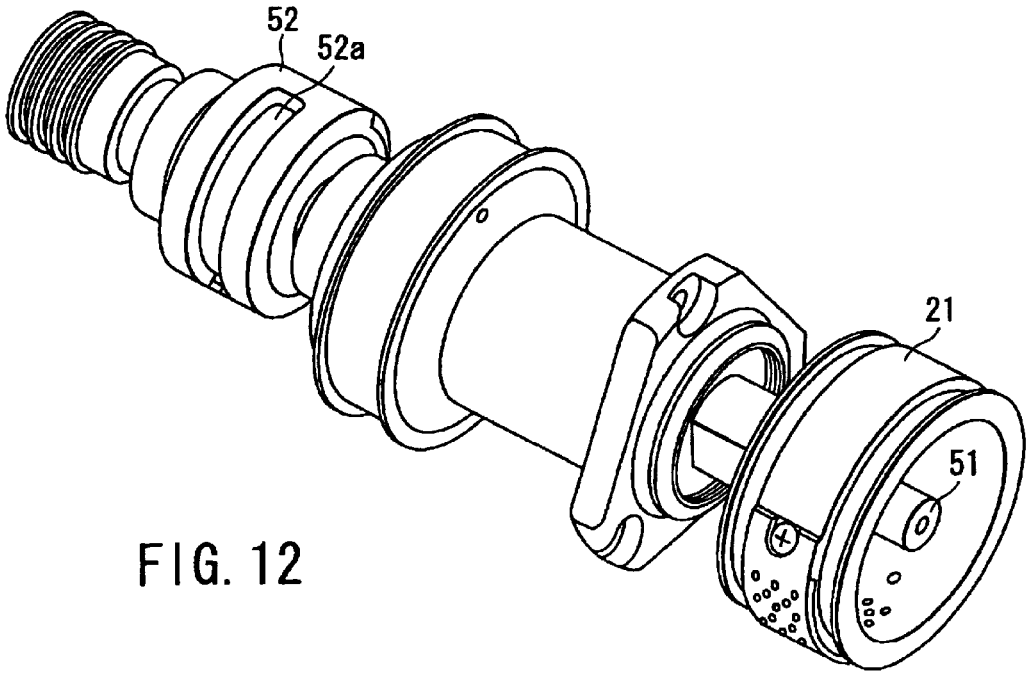
FIG. 12 is a perspective view showing the state that a valve cover is removed from the paper sheet take-out apparatus.

In a part of the outer circumference of the rotary valve 52, a groove 52*a* is formed along the circumferential direction, as shown in FIG. 12. The groove 52*a* connects with the first and second piping members 55, 56 through first and second fixing ports 54*a*, 54*b*.

Figure 13:
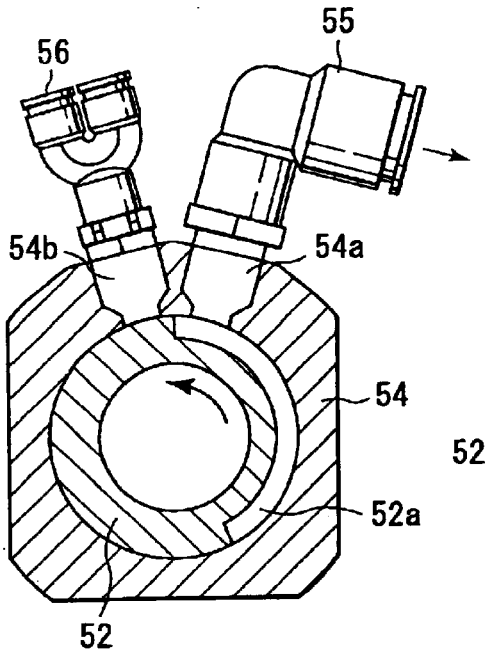
FIG. 13 is a sectional view showing the state that a groove of a rotary valve of the paper sheet take-out apparatus connects with a first piping member.
Figure 14:
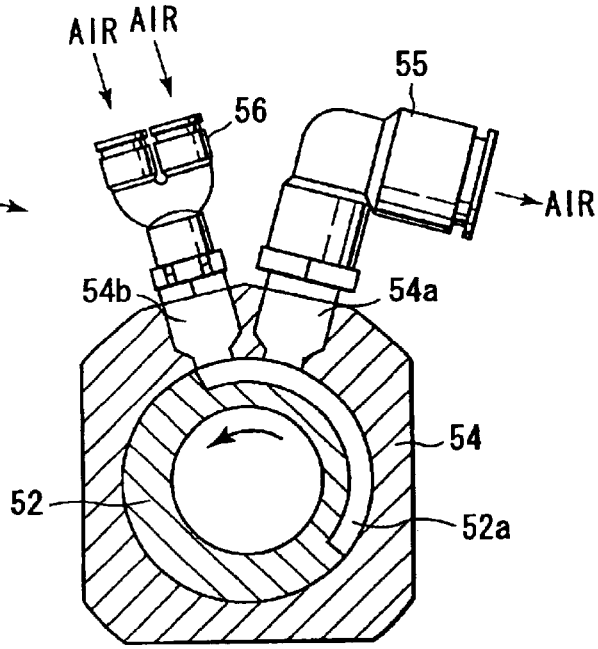
FIG. 14 is a sectional view showing the state that the groove of the rotary valve of the paper sheet take-out apparatus connects with the first and second piping members.

In a paper sheet take-out apparatus configured as described above, when the rotary valve 52 is rotated by the rotation of the driving shaft 51, and the groove 52*a* connects with the fixing port 54*a* of the first piping member 55, as shown in FIG. 13, the air in the groove 52*a* is sucked by the vacuum pump 59, and the inside attains negative pressure. Further, as shown in FIG. 14, when the rotary valve 52 rotates and the groove 52*a* connects with the second piping member 56, the air is sucked through the absorption pipes 62, 62 of the absorption blocks 29, 29.

Figure 15:
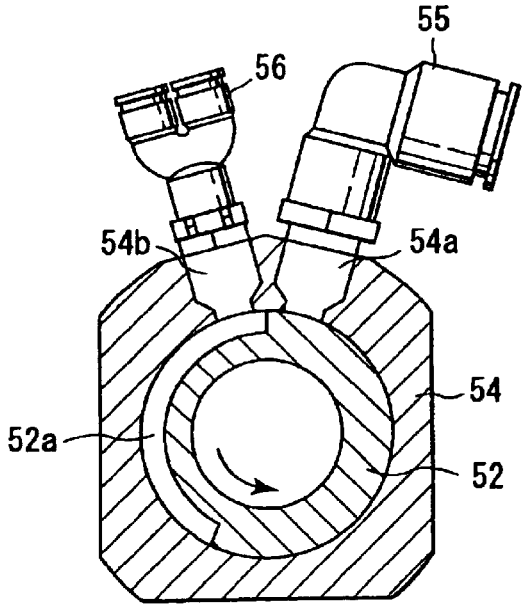
FIG. 15 is a sectional view showing that the groove of the rotary valve of the paper sheet take-out apparatus disconnects from the first piping member.

Thus, the uppermost paper sheet of the paper sheet stack is absorbed and positioned by the suction ports 29*a*, 29*a* of the absorption blocks 29, 29. After being positioned, the paper sheet is absorbed and taken out by the take-out rotor. In the take-out procedure, as shown in FIG. 15, the rotary valve 52 rotates, and the groove 52*a* separates from the fixing port 54*b* of the first piping member 55. Thus, the air sucking from the absorption pipes 62, 62 of the absorption blocks 29, 29 is stopped, not disturbing the paper sheet take-out operation.

In this embodiment, also, the same function and effect as in the first embodiment can be obtained.

Of course, the present invention is not limited to the above-mentioned embodiments, and may be embodied in other various forms without departing from its essential characteristics.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper sheet take-out apparatus, comprising:

a paper feed table adapted to hold a stack of paper sheets;

a take-out rotor, disposed adjacent to the paper feed table, comprising a circumferential surface defining a take-out rotor chamber and a suction port; and a positioning device, disposed adjacent to the take-out rotor, comprising a positioning device chamber, disposed adjacent to the circumferential surface and opened toward the circumferential surface, and an absorption block disposed adjacent to the take-out rotor and being operatively connected thereto, the absorption block defining an absorption block suction port, wherein, during operation, the circumferential surface rotates, thereby rotating the suction port, the take-out rotor chamber is operated under a vacuum, thereby drawing air through the suction port, when the suction port is in register with the positioning device chamber, air is drawn from the positioning device chamber and the absorption block suction port, thereby causing the absorption block to absorb an uppermost paper sheet from the paper feed table, and when the suction port is not in register with the positioning device chamber, the absorption block releases the uppermost paper sheet, permitting the uppermost paper sheet to be captured by the suction port so that the uppermost paper sheet may be taken out from the paper feed table by the take-out rotor.

2. The paper sheet take-out apparatus of claim 1, further comprising:

a connection pipe connecting the absorption block to the positioning device chamber.

3. The paper sheet take-out apparatus of claim 1, wherein the absorption block comprises two absorption blocks, one disposed one either side of the take-out rotor.

4. The paper sheet take-out apparatus of claim 3, further comprising two connection pipes, one connecting each of the two absorption blocks to the positioning device chamber.

5. A paper sheet take-out apparatus, comprising:

a paper feed table adapted to hold a stack of paper sheets;

a take-out rotor, disposed adjacent to the paper feed table, comprising a circumferential surface defining a take-out rotor chamber and a suction port;

a positioning device, disposed adjacent to the take-out rotor, comprising a positioning device chamber, disposed adjacent to the circumferential surface and opened toward the circumferential surface, and an absorption block disposed adjacent to the take-out rotor and being operatively connected thereto, the absorption block defining an absorption block suction port, wherein, during operation, the circumferential surface rotates, thereby rotating the suction port, the take-out rotor chamber is operated under a vacuum, thereby drawing air through the suction port, when the suction port is in register with the positioning device chamber, air is drawn from the positioning device chamber and the absorption block suction port, thereby causing the absorption block to absorb an uppermost paper sheet from the paper feed table, and when the suction port is not in register with the positioning device chamber, the absorption block releases the uppermost paper sheet, permitting the uppermost paper sheet to be captured by the suction part so that the uppermost paper sheet may be taken out from the paper feed table by the take-out rotor, and a separation roller, disposed adjacent to the take-out rotor, wherein, during operation, the separation roller rotates oppositely to the take-out rotor, the separation roller separates any paper sheets attached to the uppermost paper sheet taken out from the paper feed table.

6. The paper sheet take-out apparatus of claim 5, further comprising:

a connection pipe connecting the absorption block to the positioning device chamber.

7. The paper sheet take-out apparatus of claim 5, wherein the absorption block comprises two absorption blocks, one disposed one either side of the take-out rotor.

8. The paper sheet take-out apparatus of claim 7, further comprising two connection pipes, one connecting each of the two absorption blocks to the positioning device chamber.

9. A paper sheet take-out apparatus, comprising:

a paper feed table adapted to hold a stack of paper sheets;

a take-out rotor, disposed adjacent to the paper feed table, comprising a circumferential surface defining a take-out rotor chamber and a suction port;

a positioning device, disposed adjacent to the take-out rotor, comprising a positioning device chamber, disposed adjacent to the circumferential surface and opened toward the circumferential surface, and an absorption block disposed adjacent to the take-out rotor and operatively connected thereto, the absorption block defining an absorption block suction port, wherein, during operation, the circumferential surface rotates, thereby rotating the suction port, the take-out rotor chamber is operated under a vacuum, thereby drawing air through the suction port, when the suction port is in register with the positioning device chamber, air is drawn from the positioning device chamber and the absorption block suction port, thereby causing the absorption block to absorb an uppermost paper sheet from the paper feed table, and when the suction port is not in register with the positioning device chamber, the absorption block releases the uppermost paper sheet, permitting the uppermost paper sheet to be captured by the suction port so that the uppermost paper sheet may be taken out from the paper feed table by the take-out rotor; and an air nozzle disposed adjacent to the take-out rotor, wherein, during operation, the air nozzle blows air onto the paper sheets, thereby assisting with the taking out of the uppermost paper sheet from the paper feed table.

10. The paper sheet take-out apparatus of claim 9, further comprising:

a connection pipe connecting the absorption block to the positioning device chamber.

11. The paper sheet take-out apparatus of claim 9, wherein the absorption block comprises two absorption blocks, one disposed one either side of the take-out rotor.

12. The paper sheet take-out apparatus of claim 11, further comprising two connection pipes, one connecting each of the two absorption blocks to the positioning device chamber.

13. The paper sheet take-out apparatus of claim 9, wherein, during operation, when blowing air onto the stack of paper sheets, the air nozzle assists with the separation of the uppermost sheet of paper from the stack of paper sheets.

14. A paper sheet take-out apparatus, comprising:

a paper feed table adapted to hold a stack of paper sheets;

a vacuum source;

a take-out rotor, disposed adjacent the paper feed table and operatively connected to the vacuum source, the take-our rotor comprising a circumferential surface defining a take-out rotor chamber and a suction port, wherein, during operation, the circumferential surface and the suction port rotate;

a positioning device comprising a rotary valve, operatively connected to the vacuum source and disposed adjacent to the take-out rotor, and an absorption block disposed adjacent to the take-out rotor and being operatively connected to the rotary valve, the absorption block defining an absorption block suction port, wherein, during operation, the rotary valve rotates, during at least a portion of the rotary valve's rotation, the rotary valve permits air to be drawn through the absorption block suction port, thereby causing the absorption block to absorb an uppermost paper sheet from the paper feed table, and during at least another portion of the rotary valve's rotation, the vacuum is disconnected from the absorption block, permitting the absorption block to release the uppermost paper sheet, thereby permitting the uppermost paper sheet to be captured by the suction port so that the uppermost paper sheet may be taken out from the paper feed table by the take-out rotor.

15. The paper sheet take-out apparatus of claim 14, further comprising:

a connection pipe connecting the absorption block to the rotary valve.

16. The paper sheet take-out apparatus of claim 14, wherein the absorption block comprises two absorption blocks, one disposed one either side of the take-out rotor.

17. The paper sheet take-out apparatus of claim 14, further comprising two connection pipes, one connecting each of the two absorption blocks to the rotary valve.

18. The paper sheet take-out apparatus of claim 14, wherein the rotary valve further comprises a valve cover surrounding a rotary valve circumferential surface, the rotary valve circumferential surface defining a groove therein, wherein, during operation, the groove connects the absorption block to the vacuum source so that the absorption valve may absorb the uppermost paper sheet.

* * * * *